US011427896B2

(12) United States Patent
Hasegawa et al.

(10) Patent No.: US 11,427,896 B2
(45) Date of Patent: Aug. 30, 2022

(54) SOFT MAGNETIC ALLOY RIBBON AND MAGNETIC DEVICE

(71) Applicant: TDK CORPORATION, Tokyo (JP)

(72) Inventors: Akito Hasegawa, Tokyo (JP); Hironobu Kumaoka, Tokyo (JP); Kazuhiro Yoshidome, Tokyo (JP); Hiroyuki Matsumoto, Tokyo (JP); Kenji Horino, Tokyo (JP); Isao Nakahata, Tokyo (JP)

(73) Assignee: TDK CORPORATION, Tokyo (JP)

( * ) Notice: Subject to any disclaimer, the term of this patent is extended or adjusted under 35 U.S.C. 154(b) by 157 days.

(21) Appl. No.: 16/961,583

(22) PCT Filed: Dec. 3, 2018

(86) PCT No.: PCT/JP2018/044410
§ 371 (c)(1),
(2) Date: Jul. 10, 2020

(87) PCT Pub. No.: WO2019/138730
PCT Pub. Date: Jul. 18, 2019

(65) Prior Publication Data

US 2020/0362442 A1 Nov. 19, 2020

(30) Foreign Application Priority Data

Jan. 12, 2018 (JP) ..... JP2018-003405
Aug. 29, 2018 (JP) ..... JP2018-160491
Oct. 31, 2018 (JP) ..... JP2018-205074

(51) Int. Cl.
*C22C 38/12* (2006.01)
*H01F 1/147* (2006.01)
(Continued)

(52) U.S. Cl.
CPC ..... *C22C 38/12* (2013.01); *B22D 23/003* (2013.01); *C21D 6/008* (2013.01); *C21D 9/52* (2013.01);
(Continued)

(58) Field of Classification Search
None
See application file for complete search history.

(56) References Cited

U.S. PATENT DOCUMENTS 6,273,967 B1 8/2001 Matsuki et al.
2009/0065100 A1 3/2009 Yoshizawa et al.
(Continued)

FOREIGN PATENT DOCUMENTS

CN 1164578 A 11/1997
EP 2463397 A1 6/2012
(Continued)

OTHER PUBLICATIONS

Machine translation of WO2018/062037. (Year: 2018).*
(Continued)

*Primary Examiner* — Xiaowei Su
(74) *Attorney, Agent, or Firm* — Oliff PLC

(57) ABSTRACT

A soft magnetic alloy thin strip which has high saturation magnetic flux density and low coercivity, which enables a core with high space factor and high saturation magnetic flux density. A soft magnetic alloy thin strip including a main component that has a composition formula $(Fe_{(1-(\alpha+\beta))}X1_{\alpha}X2_{\beta})_{(1-(a+b+c+d+e+f))}M_aB_bP_cSi_dC_eS_f$. In the formula, X1, X2 and M are selected from a specific element group; $0 \le a \le 0.140$, $0.020 \le b \le 0.200$, $0 \le c \le 0.150$, $0 \le d \le 0.090$, $0 \le e \le 0.030$, $0 \le f \le 0.030$, $\alpha \ge 0$, $\beta \ge 0$, and $0 \le \alpha+\beta \le 0.50$; and at least one of a, c and d is larger than 0. The strip has a structure that is composed of an Fe-based nanocrystal; and the surface roughness of a release surface satisfies $0.85 \le Ra_e/$
(Continued)

$Ra_c \leq 1.25$ (wherein $Ra_c$ is the average of arithmetic mean roughnesses in the central portion, and $Ra_e$ is the average in the edge portion).

14 Claims, 5 Drawing Sheets

(51) Int. Cl.

| | |
|---|---|
| ***C22C 38/02*** | (2006.01) |
| ***C22C 38/00*** | (2006.01) |
| ***B22D 23/00*** | (2006.01) |
| ***C21D 6/00*** | (2006.01) |
| ***C21D 9/52*** | (2006.01) |
| ***C22C 45/02*** | (2006.01) |

(52) U.S. Cl.
CPC ..... *C22C 38/002* (2013.01); *C22C 38/02* (2013.01); *C22C 45/02* (2013.01); *H01F 1/147* (2013.01); *C22C 2200/02* (2013.01); *C22C 2200/04* (2013.01); *C22C 2202/02* (2013.01)

(56) References Cited

U.S. PATENT DOCUMENTS

| | | | |
|---|---|---|---|
| 2010/0097171 | A1 | 4/2010 | Urata et al. |
| 2015/0027592 | A1 | 1/2015 | Shibasaki et al. |
| 2017/0044648 | A1 | 2/2017 | Shibasaki et al. |
| 2018/0122540 | A1* | 5/2018 | Matsumoto ..... C22C 38/18 |
| 2018/0122542 | A1 | 5/2018 | Matsumoto et al. |

FOREIGN PATENT DOCUMENTS

| | | | |
|---|---|---|---|
| JP | 2002-316243 | A | 10/2002 |
| JP | 3342767 | B2 | 11/2002 |
| JP | 2012-012699 | A | 1/2012 |
| JP | 6160759 | B1 | 7/2017 |
| JP | 6160760 | B1 | 7/2017 |
| TW | 200903534 | A | 1/2009 |
| WO | 2013/137117 | A1 | 9/2013 |
| WO | 2018/062037 | A1 | 4/2018 |

OTHER PUBLICATIONS

Jul. 28, 2021 Office Action issued in U.S. Appl. No. 16/234,941.
Feb. 19, 2019 International Search Report issued in International Patent Application No. PCT/JP2018/044410.
U.S. Appl. No. 16/234,941, filed Dec. 28, 2018 in the name of Kazuhiro Yoshidome et al.
Jul. 14, 2020 International Preliminary Report on Patentability issued in International Patent Application No. PCT/JP2018/044410.
Apr. 7, 2022 Office Action issued in U.S. Appl. No. 16/234,941.

* cited by examiner

SOFT MAGNETIC ALLOY RIBBON AND MAGNETIC DEVICE

FIELD OF THE INVENTION

The present invention relates to a soft magnetic alloy ribbon and a magnetic device.

RELATED ART

Low power consumption and high efficiency have been demanded in electronic, information, communication equipment, and the like. Moreover, the above demands are becoming stronger for a low carbon society. Thus, reduction in energy loss and improvement in power supply efficiency are also required for power supply circuits of electronic, information, communication equipment, and the like.

It is known that a soft magnetic alloy ribbon is used as a material for manufacturing a core of a magnetic element used in power supply circuits. In this case, in addition to soft magnetic characteristics of the soft magnetic alloy ribbon itself, a space factor of the core after manufacturing it using the soft magnetic alloy ribbon, that is, a proportion of a conductor on a cross section of the core is also required to be high.

Patent Document 1 discloses a Fe—B—Si type amorphous alloy ribbon. In the Fe—B—Si type amorphous alloy ribbon, controlling a surface roughness improves the saturation magnetic flux density of the ribbon itself and makes it possible to increase a space factor of a core after manufacturing it.

PRIOR ART

Patent Document

Patent Document 1: WO2018062037 (A1)

SUMMARY OF THE INVENTION

Problem to be Solved by the Invention

It is an object of the invention to provide a soft magnetic alloy ribbon exhibiting a high saturation magnetic flux density and a low coercivity and being able to provide a core having a high space factor and a high saturation magnetic flux density.

Means for Solving the Problem

To achieve the above object, a soft magnetic alloy ribbon according to the present invention includes a main component of $(Fe_{(1-(\alpha+\beta))}X1_{\alpha}X2_{\beta})_{(1-(a+b+c+d+e+f))}M_aB_bP_cSi_dC_eS_f$, in which X1 is one or more of Co and Ni, X2 is one or more of Al, Mn, Ag, Zn, Sn, As, Sb, Cu, Cr, Bi, N, O, and rare earth elements, M is one or more of Nb, Hf, Zr, Ta, Mo, W, Ti, and V, $0 \le a \le 0.140$, $0.020 \le b < 0.200$, $0 \le c \le 0.150$, $0 \le d \le 0.090$, $0 \le e \le 0.030$, $0 \le f \le 0.030$, $\alpha \ge 0$, $\beta \ge 0$, and $0 \le \alpha+\beta \le 0.50$ are satisfied, and at least one or more of a, c, and d are larger than zero, wherein the soft magnetic alloy ribbon has a Fe based nanocrystal structure, the soft magnetic alloy ribbon has a peeled surface and a free surface both perpendicular to a thickness direction of the ribbon, the soft magnetic alloy ribbon has edge parts and a central part along a width direction of the ribbon, and $0.85 \le Ra_e/Ra_c \le 1.25$ is satisfied in measuring an arithmetic mean roughness along the width direction on the peeled surface, where $Ra_c$ is an average of arithmetic mean roughnesses in the central part, and $Ra_e$ is an average of arithmetic mean roughnesses in the edge parts.

The soft magnetic alloy ribbon according to the present invention has the above-mentioned composition, the Fe based nanocrystal structure, and the above-mentioned mean roughnesses and thereby exhibits a high saturation magnetic flux density and a low coercivity and makes it possible to provide a core having a high space factor and a high saturation magnetic flux density.

In the soft magnetic alloy ribbon according to the present invention, the Fe based nanocrystals may have an average grain size of 5 to 30 nm.

In the soft magnetic alloy ribbon according to the present invention, $0.73 \le 1-(a+b+c+d+e+f) \le 0.91$ may be satisfied.

In the soft magnetic alloy ribbon according to the present invention, $0 \le \alpha\{1-(a+b+c+d+e+f)\} \le 0.40$ may be satisfied.

In the soft magnetic alloy ribbon according to the present invention, $\alpha=0$ may be satisfied.

In the soft magnetic alloy ribbon according to the present invention, $0 \le \beta\{1-(a+b+c+d+e+f)\} \le 0.030$ may be satisfied.

In the soft magnetic alloy ribbon according to the present invention, $\beta=0$ may be satisfied.

In the soft magnetic alloy ribbon according to the present invention, $\alpha=\beta=0$ may be satisfied.

In the soft magnetic alloy ribbon according to the present invention, $Ra_c$ may be 0.50 μm or less.

In the soft magnetic alloy ribbon according to the present invention, an average of maximum height roughnesses along a casting direction of the ribbon on the free surface may be 0.43 μm or less.

A magnetic device according to the present invention is made of the soft magnetic alloy ribbon.

EMBODIMENTS FOR CARRYING OUT THE INVENTION

Hereinafter, an embodiment of the present invention is explained with figures.

(Size of Soft Magnetic Alloy Ribbon)

A soft magnetic alloy ribbon according to the present embodiment has any size. For example, a soft magnetic alloy ribbon 24 with the shape shown in FIG. 3 may have a thickness (length in the z-axis direction) of 15-30 μm and a width (length in the y-axis direction) of 100-1000 mm.

When the soft magnetic alloy ribbon 24 has a thickness of 15 μm or more, it is easy to sufficiently secure mechanical strength and workability, to reduce surface undulation, and to sufficiently increase a space factor of a core. When the soft magnetic alloy ribbon 24 has a thickness of 30 μm or less, it is easy to prevent embrittlement during casting, and coarse crystals are less likely to occur in the soft magnetic alloy ribbon 24 before heat treatment. Incidentally, a space factor of a core is a proportion of a conductor on a cross section of a core.

When the soft magnetic alloy ribbon 24 has a width of 100 mm or more, saturation magnetic flux density is easily improved. This is because the influence of edge parts 41, where saturation magnetic flux density tends to be small, is small. When the soft magnetic alloy ribbon 24 has a width of 1000 mm or less, saturation magnetic flux density is easily improved. This is because the cooling rate easily becomes uniform over the entire ribbon during the casting mentioned below.

Figure 3:
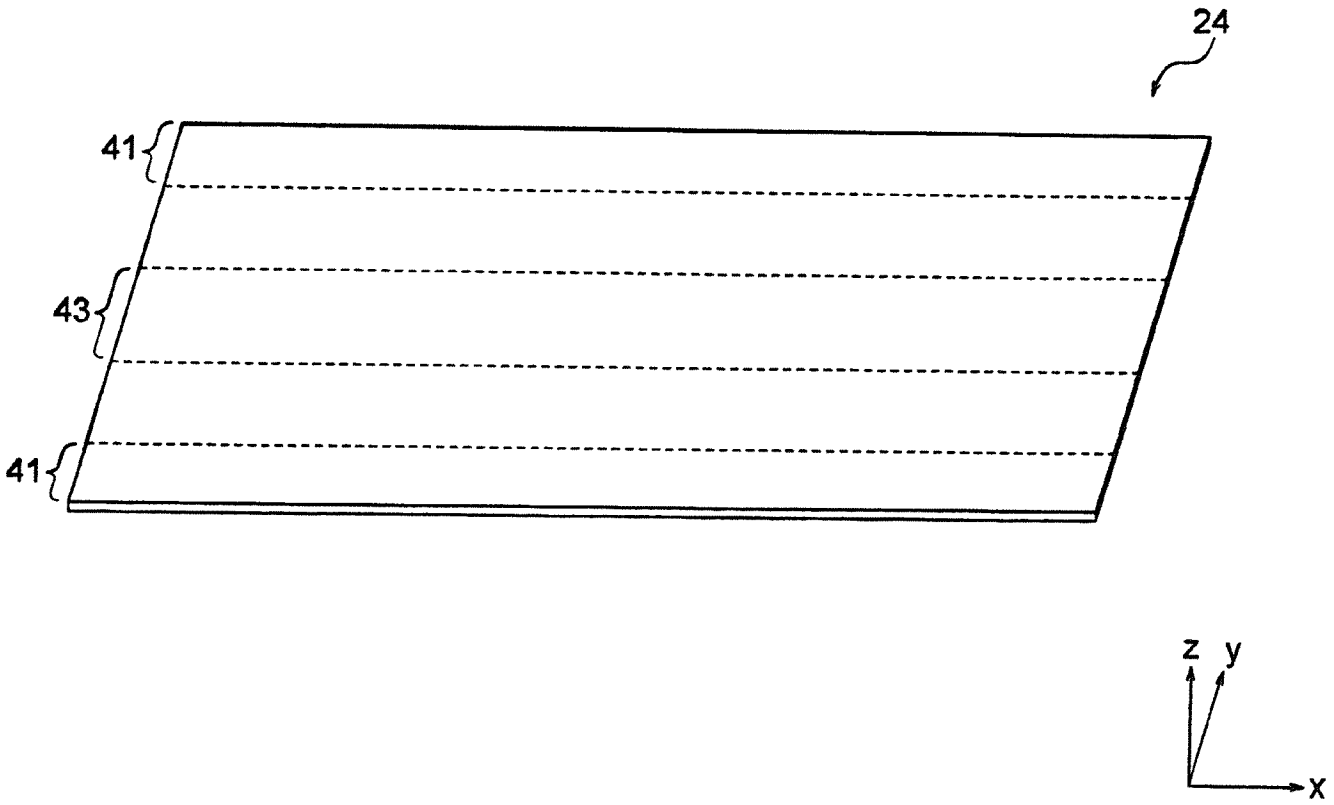
FIG. 3 is a schematic view illustrating positions of edge parts and a central part.

As shown in FIG. 3, the soft magnetic alloy ribbon 24 according to the present embodiment has edge parts 41 and a central part 43 in the width direction (y-axis direction).

Each of the edge parts 41 of the soft magnetic alloy ribbon 24 is a region up to 20 mm from an edge of the soft magnetic alloy ribbon 24 in the y-axis direction toward the center (a point where the distances from both edges are equal to each other). That is, this region means a region whose distance from either of the edges is 0-20 mm.

The central part 43 of the soft magnetic alloy ribbon 24 means a region of 3L/8 to 5L/8 from either of the edges of the soft magnetic alloy ribbon 24 toward the other edge in the y-axis direction, where L is a width of the soft magnetic alloy ribbon 24. That is, the central part 43 of the soft magnetic alloy ribbon 24 means a region where each of the distances from both edges is 3L/8 to 5L/8.

(Composition of Soft Magnetic Alloy Ribbon)

The soft magnetic alloy ribbon 24 according to the present embodiment includes a main component of $(Fe_{(1-(\alpha+\beta))}X1_{\alpha}X2_{\beta})_{(1-(a+b+c+d+e+f))}M_aB_bP_cSi_dC_eS_f$, in which X1 is one or more of Co and Ni, X2 is one or more of Al, Mn, Ag, Zn, Sn, As, Sb, Cu, Cr, Bi, N, O, and rare earth elements, M is one or more of Nb, Hf, Zr, Ta, Mo, W, Ti, and V, $0 \le a \le 0.140$, $0.020 \le b \le 0.200$, $0 \le c \le 0.150$, $0 \le d \le 0.090$, $0 \le e \le 0.030$, $0 \le f \le 0.030$, $\alpha \ge 0$, $\beta \ge 0$, and $0 \le \alpha+\beta \le 0.50$ are satisfied, and at least one or more of a, c, and d are larger than zero, wherein the soft magnetic alloy ribbon has a Fe based nanocrystal structure.

When a soft magnetic alloy ribbon having the above-mentioned composition is subjected to heat treatment, Fe based nanocrystals are easily deposited in the soft magnetic alloy ribbon 24. In other words, a soft magnetic alloy ribbon having the above-mentioned composition is easily used as a starting material for the soft magnetic alloy ribbon 24 in which Fe-based nanocrystals are deposited.

A soft magnetic alloy ribbon before heat treatment having the above-mentioned composition may have a structure composed of only amorphousness or may have a nanohetero structure in which initial fine crystals exist in amorphousness. The initial fine crystals may have an average grain size of 0.3 to 10 nm. In the present embodiment, when an amorphous ratio mentioned below is 85% or more, the soft magnetic alloy ribbon before heat treatment having the above-mentioned composition has a structure compose of only amorphousness or a nanohetero structure.

The Fe based nanocrystals are crystals whose grain size is nano-order and whose crystal structure of Fe is bcc (body-centered cubic). In the present embodiment, it is preferable to deposit Fe based nanocrystals having an average grain size of 5 to 30 nm. The soft magnetic alloy ribbon 24 in which such Fe based nanocrystals are deposited is easy to have a high saturation magnetic flux density and a low coercivity. In the present embodiment, when the soft magnetic alloy ribbon has a Fe based nanocrystal structure, an amorphous ratio mentioned below is less than 85%.

Hereinafter, explained is a method of confirming whether the soft magnetic alloy ribbon has a structure composed of amorphous phase (a structure composed of only amorphousness or a nanohetero structure) or a structure composed of crystal phase. In the present embodiment, the soft magnetic alloy ribbon whose amorphous ratio X shown in the following formula (1) is 85% or more has a structure composed of amorphous phase, and the soft magnetic alloy ribbon whose amorphous ratio X shown in the following formula (1) is less than 85% has a structure composed of crystal phase.

$$X=100-(Ic/(Ic+Ia)\times 100) \quad (1)$$

Ic: scattering integrated intensity of crystal phase

Ia: scattering integrated intensity of amorphous phase

The amorphous ratio X is calculated from the above-mentioned formula (1) by performing X-ray crystal structure analysis for the soft magnetic alloy ribbon by XRD to identify the phase and reading peaks of crystallized Fe or a compound (Ic: scattering integrated intensity of crystal phase, Ia: scattering integrated intensity of amorphous phase) to obtain a crystallization rate from the peak intensities. Hereinafter, the calculation method is explained more specifically.

Figure 4:
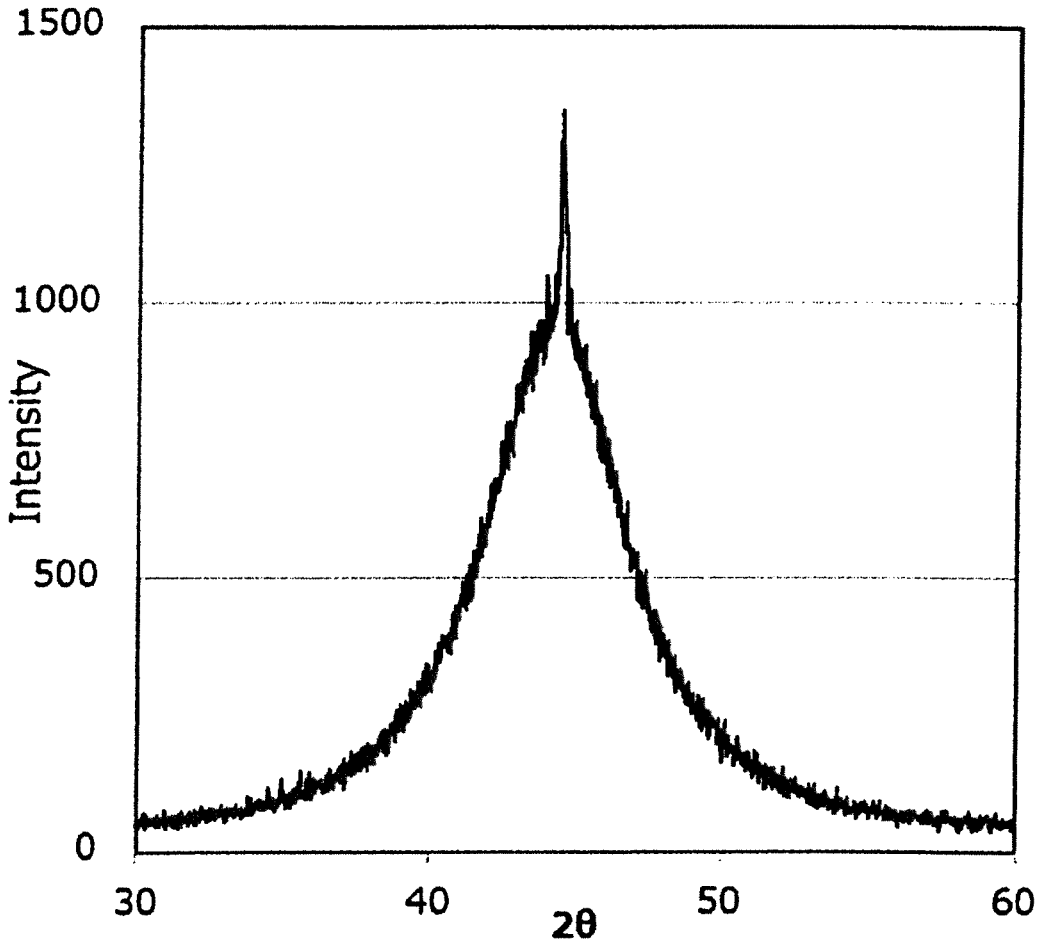
FIG. 4 is a chart obtained by X-ray crystal structure analysis.
Figure 5:
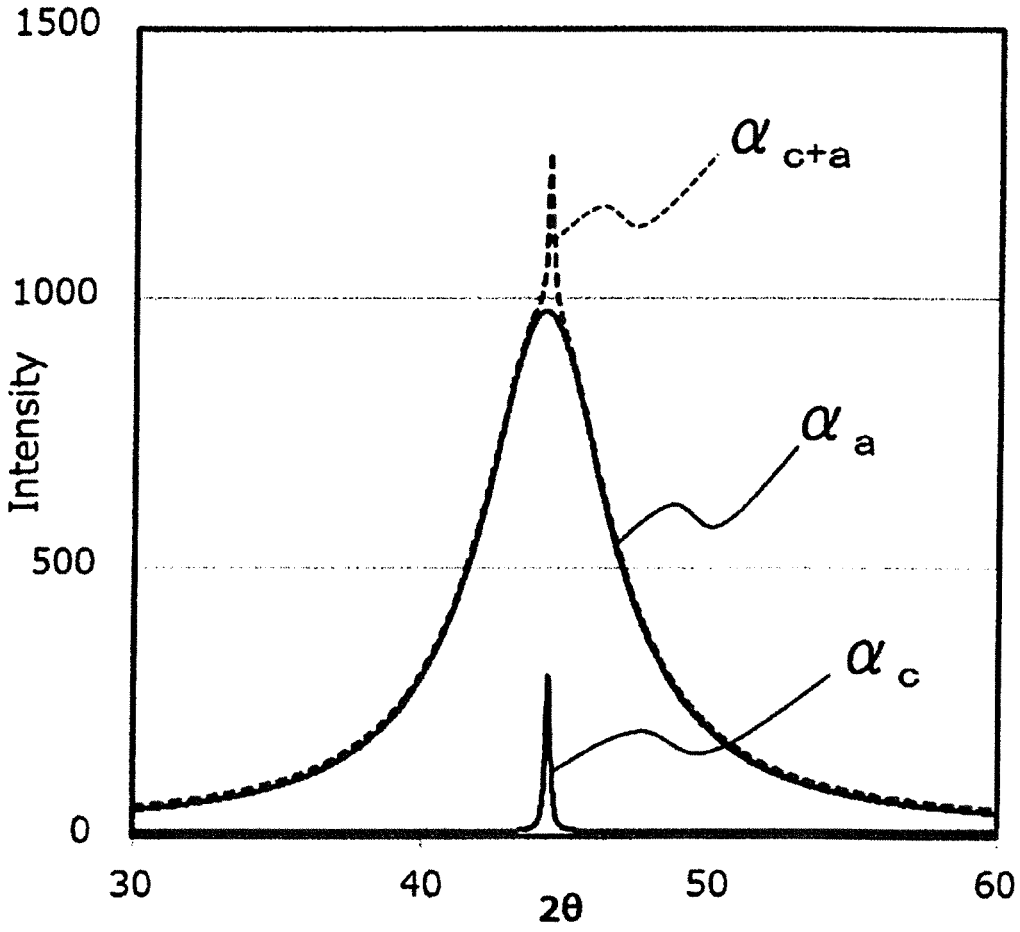
FIG. 5 is a pattern obtained by profile fitting of the chart of FIG. 4.

The soft magnetic alloy ribbon according to the present embodiment is subjected to X-ray crystal structure analysis by XRD to obtain a chart as shown in FIG. 4. This is subjected to profile fitting using the Lorentz function of the following formula (2) so as to calculate a crystalline component pattern $\alpha_c$ denoting a scattering integrated intensity of crystal phase, an amorphous component pattern $\alpha_a$ denoting a scattering integrated intensity of amorphous phase, and a pattern $\alpha_{c+a}$ obtained by combining them as shown in FIG. 5. From the scattering integrated intensity of crystal phase and the scattering integrated intensity of amorphous phase of the obtained patterns, an amorphous ratio X is obtained by the above-mentioned formula (1). Incidentally, the measurement range is a diffraction angle 2θ=30° to 60°, in which a halo derived from amorphousness can be confirmed. In this range, an error between the actually measured integrated intensity with XRD and the integrated intensity calculated by the Lorentz function is set to be within 1%.

$$f(x) = \frac{h}{1+\frac{(x-u)^2}{w^2}} + b \quad (2)$$

*u*: peak height

*u*: peak position

*w*: half- value width

*b*: backgroundheight

Hereinafter, each component of the soft magnetic alloy ribbon 24 according to the present embodiment is explained in detail.

M is one or more of Nb, Hf, Zr, Ta, Mo, W, Ti, and V.

The M content (a) satisfies $0 \le a \le 0.140$. That is, M may not be contained. The M content (a) is preferably $0.020 \leq a \leq 0.120$, more preferably $0.040 \leq a \leq 0.100$, and still more preferably $0.060 \leq a \leq 0.080$. When the M content (a) is large, saturation magnetic flux density easily becomes low.

The smaller the M content (a) is, the larger the surface roughness of the soft magnetic alloy ribbon 24 mentioned below tends to be. When the M content (a) is too large, the surface roughness ratio mentioned below tends to be small.

The B content (b) satisfies $0.020 \leq b \leq 0.200$. The B content (b) may be $0.025 \leq b \leq 0.200$ and is preferably $0.060 \leq b \leq 0.150$, more preferably $0.080 \leq b \leq 0.120$. When the B content (b) is small, a crystal phase composed of crystals having a particle size of larger than 30 nm is easily generated in the soft magnetic alloy ribbon before heat treatment. When the crystal phase is generated, Fe based nanocrystals cannot be deposited by heat treatment, and coercivity easily becomes high. When the B content (b) is large, saturation magnetic flux density easily becomes low.

The smaller the B content (b) is, the larger the surface roughness of the soft magnetic alloy ribbon 24 mentioned below tends to be. When the B content (b) is too large or too small, the surface roughness ratio mentioned below tends to be small.

The P content (c) satisfies $0 \leq c \leq 0.150$. That is, P may not be contained. The P content (c) is preferably $0.030 \leq c \leq 0.100$, more preferably $0.030 \leq c \leq 0.050$. When the P content (c) is large, saturation magnetic flux density easily becomes low.

The smaller the P content (c) is, the larger the surface roughness of the soft magnetic alloy ribbon 24 mentioned below tends to be. When the P content (c) is too large, the surface roughness ratio mentioned below tends to be small.

The Si content (d) satisfies $0 \leq d \leq 0.090$. That is, Si may not be contained. Preferably, $0 \leq d \leq 0.020$ is satisfied. When the soft magnetic alloy ribbon contains Si, coercivity easily becomes low. When the Si content (d) is large, coercivity easily increases on the contrary.

The larger the Si content (d) is, the smaller surface roughness of the soft magnetic alloy ribbon 24 mentioned below tends to be.

The C content (e) satisfies $0 \leq e \leq 0.030$. That is, C may not be contained. Preferably, the C content (e) is $0.001 \leq e \leq 0.010$. When the soft magnetic alloy contains C, coercivity easily becomes low. When the C content (e) is large, a crystal phase composed of crystals having a particle size of larger than 30 nm is easily generated in the soft magnetic alloy ribbon before heat treatment. When the crystal phase is generated, Fe based nanocrystals cannot be deposited by heat treatment, and coercivity easily becomes high.

The S content (f) satisfies $0 \leq f \leq 0.030$. That is, S may not be contained. When the soft magnetic alloy contains S, the surface roughness mentioned below tends to be low. When the S content (f) is large, a crystal phase composed of crystals having a particle size of larger than 30 nm is easily generated in the soft magnetic alloy ribbon before heat treatment. When the crystal phase is generated, Fe based nanocrystals cannot be deposited by heat treatment, and coercivity easily becomes high.

In the soft magnetic alloy ribbon according to the present embodiment, at least one or more of "a", "c", and "d" are larger than zero. That is, at least one or more of M, P, and Si are contained. Incidentally, at least one or more of "a", "c", and "d" are larger than zero means that at least one or more of "a", "c", and "d" are 0.001 or more. Moreover, at least one or more of "a" and "c" may be larger than zero. That is, at least one or more of M and P may be contained. In addition, "a" is preferably larger than zero for remarkably reducing coercivity.

The Fe content $(1-(a+b+c+d+e+f))$ is not limited, but $0.73 \leq (1-(a+b+c+d+e+f)) \leq 0.95$ may be satisfied, or $0.73 \leq (1-(a+b+c+d+e+f)) \leq 0.91$ may be satisfied. When the Fe content $(1-(a+b+c+d+e+f+g))$ is in the above range, a crystal phase composed of crystals having a particle size of larger than 30 nm is harder to be generated in manufacturing the soft magnetic alloy ribbon.

In the soft magnetic alloy ribbon according to the present embodiment, a part of Fe may be substituted by X1 and/or X2.

X1 is one or more of Co and Ni. The X1 content may be $\alpha=0$. That is, X1 may not be contained. Preferably, the number of atoms of X1 is 40 at % or less if the number of atoms of the entire composition is 100 at %. That is, $0 \leq \alpha\{1-(a+b+c+d+e+f)\} \leq 0.40$ is preferably satisfied.

X2 is one or more of Al, Mn, Ag, Zn, Sn, As, Sb, Cu, Cr, Bi, N, O, and rare earth elements. The content X2 may be $\beta=0$. That is, X2 may not be contained. Preferably, the number of atoms of X2 is 3.0 at % or less if the number of atoms of the entire composition is 100 at %. That is, $0 \leq \beta\{1-(a+b+c+d+e+f)\} \leq 0.030$ is preferably satisfied.

The substitution amount of Fe by X1 and/or X2 is half or less of Fe based on the number of atoms. That is, $0 \leq \alpha+\beta \leq 0.50$ is satisfied. When $\alpha+\beta>0.50$ is satisfied, the soft magnetic alloy according to the present embodiment is hard to be obtained by heat treatment.

Incidentally, the soft magnetic alloy ribbon according to the present embodiment may contain elements other than the above-mentioned elements as unavoidable impurities. For example, 0.1 wt % or less of unavoidable impurities may be contained with respect to 100 wt % of the soft magnetic alloy ribbon.

(Surface Morphology of Soft Magnetic Alloy Ribbon)

In general, when the soft magnetic alloy ribbon 24 is manufactured by a method using the roller 23 (e.g., single-roller melt-spinning method shown in FIG. 1 and FIG. 2), the surface morphology of the soft magnetic alloy ribbon 24 is different between a peeled surface 24*a* (a surface in contact with the surface of the roller 23) and a free surface 24*b* (a surface not in contact with the surface of the roller 23). Incidentally, the peeled surface 24*a* and the free surface 24*b* are surfaces perpendicular to the thickness direction, and the peeled surface 24*a* and the free surface 24*b* can be distinguished visually.

(Peeled Surface of Soft Magnetic Alloy Ribbon)

In the soft magnetic alloy ribbon 24 according to the present embodiment, when an arithmetic mean roughness Ra is measured in the width direction (y-axis direction) on the peeled surface 24*a*, $0.85 \leq Ra_e/Ra_c \leq 1.25$ is satisfied, where $Ra_c$ is an average of Ra in the central part 43, and $Ra_e$ is an average of Ra in the edge parts 41. Hereinafter, $Ra_e/Ra_c$ may be simply referred to as a surface roughness ratio.

The soft magnetic alloy ribbon 24 having the above-mentioned composition, a Fe based nanocrystal structure, and a surface roughness ratio within the above-mentioned range exhibits a low coercivity and a high saturation magnetic flux density. That is, such a soft magnetic alloy ribbon 24 is excellent in soft magnetic characteristics.

When the surface roughness ratio is out of the above-mentioned range, the residual stress of the soft magnetic alloy ribbon 24 easily becomes large, the rotation of the magnetic moment is restricted by the residual stress, and the saturation magnetic flux density easily becomes low. When the surface roughness ratio is too large, the space factor easily becomes low in laminating the soft magnetic alloy ribbons 24 to form a core, and the saturation magnetic flux density of the core also easily becomes low.

In the soft magnetic alloy ribbon 24 according to the present embodiment, $Ra_c$ may be 0.50 μm or less (preferably, 0.41 μm or less). When $Ra_c$ is 0.50 μm or less, the residual stress of the soft magnetic alloy ribbon 24 easily becomes small, and the space factor is easily improved in laminating the soft magnetic alloy ribbons 24 to form a core. Incidentally, $Ra_c$ has no lower limit, but when the soft magnetic alloy ribbon 24 having an $Ra_c$ of less than 0.1 μm is manufactured by the single-roller melt-spinning method mentioned below, the roller may be polished excessively. Thus, from a point of stably manufacturing the soft magnetic alloy ribbon 24, $Ra_c$ may be 0.1 μm or more.

The surface roughness of the soft magnetic alloy ribbon 24 according to the present embodiment may be measured in contact manner or non-contact manner. The method of measuring the surface roughness conforms to JIS-B0601. Specifically, the measurement length is 4.0 mm, the cutoff wavelength is 0.8 mm, and the cutoff type is 2RC (phase non-compensation).

$Ra_e$ is calculated by determining three measurement points of the arithmetic mean roughness Ra in the edge parts 41 and averaging the measured arithmetic mean roughnesses. Incidentally, the measurement direction is the width direction (y-axis direction). This is because the arithmetic mean roughness in the width direction represents a degree of adhesion of the paddle at the initial stage of forming the ribbon and strongly affects the formation of the ribbon.

$Ra_c$ is calculated by determining three measurement points of the arithmetic mean roughness Ra in the central part 43 and averaging the measured arithmetic mean roughnesses. Incidentally, the measurement direction is the width direction (y-axis direction). This is because the arithmetic mean roughness in the width direction represents a degree of adhesion of the paddle at the initial stage of forming the ribbon and strongly affects the formation of the ribbon.

(Free Surface of Soft Magnetic Alloy Ribbon)

The soft magnetic alloy ribbon 24 according to this embodiment has any surface roughness on the free surface 24*b*, but when a maximum average roughness Rz is measured along the x-axis direction (casting direction), $Rz_c$ is preferably 4.3 μm or less, where $Rz_c$ is an average of Rz in the central part 43. When $Rz_c$ is small, it becomes easy to further improve the saturation magnetic flux density of the soft magnetic alloy ribbon 24. Incidentally, $Rz_c$ has no lower limit, but when the soft magnetic alloy ribbon 24 having an $Rz_c$ of less than 0.1 μm is manufactured by the single-roller melt-spinning method mentioned below, the roller may be polished excessively. Thus, from a point of stably manufacturing the soft magnetic alloy ribbon 24, $Rz_c$ may be 0.1 μm or more.

$Rz_c$ is calculated by determining three measurement points of the maximum average roughness Rz in the central part 43 and averaging the measured maximum height roughnesses. Incidentally, the measuring direction is the casting direction (x-axis direction). This is because when the soft magnetic alloy ribbon 24 is manufactured by a method using the roller 23 (e.g., single-roller melt-spinning method shown in FIG. 1 and FIG. 2), grooves are formed periodically in the casting direction on the free surface 24*b*.

(Method of Manufacturing Soft Magnetic Alloy Ribbon)

Hereinafter, explained is a method of manufacturing the soft magnetic alloy ribbon according to the present embodiment.

The soft magnetic alloy ribbon according to the present embodiment is manufactured in any manner. For example, the soft magnetic alloy ribbon is manufactured by a single-roller melt-spinning method. The ribbon may be a continuous ribbon.

In the single-roller melt-spinning method, pure metals of respective metal elements contained in a soft magnetic alloy ribbon finally obtained are initially prepared and weighed so that a composition identical to that of the soft magnetic alloy ribbon finally obtained is obtained. Then, the pure metals of the respective metal elements are melted and mixed to make a base alloy. Incidentally, the pure metals are melted in any manner. For example, the pure metals are melted by high-frequency heating after a chamber is evacuated. Incidentally, the base alloy and the soft magnetic alloy ribbon finally obtained normally have the same composition.

Next, the prepared base alloy is heated and melted to obtain a molten metal. The molten metal has any temperature, and may have a temperature of 1200 to 1500° C., for example.

Figure 1:
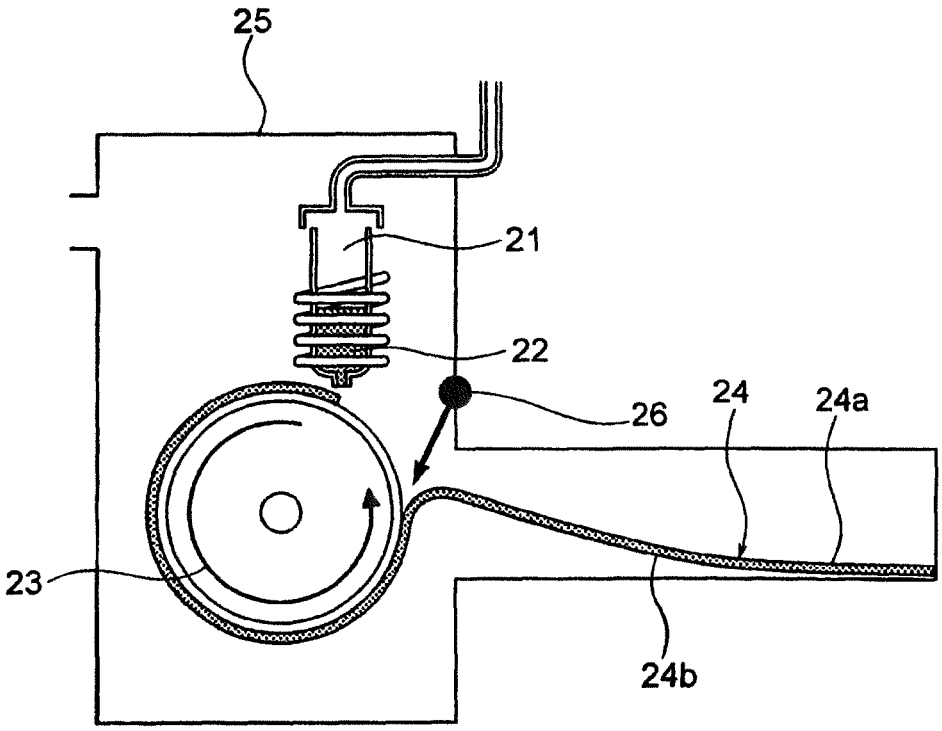
FIG. 1 is a schematic view of a single-roller melt-spinning method.

FIG. 1 is a schematic view of an apparatus used for a single-roller melt-spinning method according to the present embodiment. In the single-roller melt-spinning method according to the present embodiment, a molten metal 22 is sprayed and supplied from a nozzle 21 against a roller 23 rotating in the arrow direction, and a ribbon 24 is thereby manufactured in the rotating direction of the roller 23 in a chamber 25. In the present embodiment, the roller 23 is made of any material, such as Cu.

Figure 2:
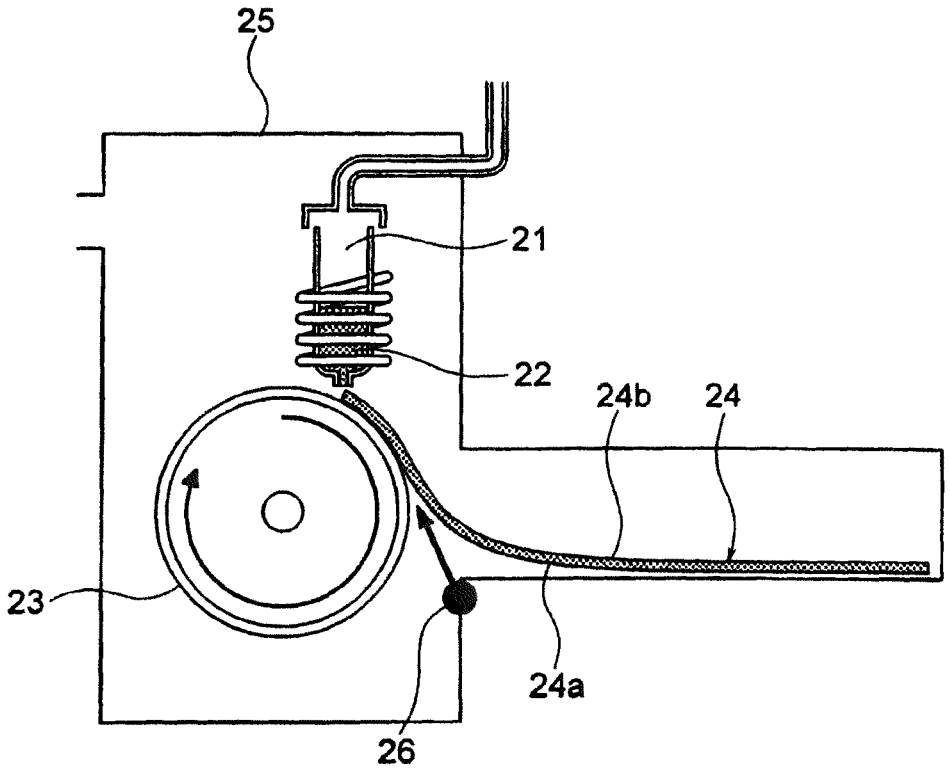
FIG. 2 is a schematic view of a single-roller melt-spinning method.

On the other hand, FIG. 2 is a schematic view of an apparatus used for a normally employed single-roller melt-spinning method. In a chamber 25, a molten metal 22 is sprayed and supplied from a nozzle 21 against a roller 23 rotating in the arrow direction, and a ribbon 24 is thereby manufactured in the rotating direction of the roller 23.

In the present embodiment, the surface roughness ratio easily falls within a predetermined range by setting the temperature of the roller 23 to 50-90° C., which is higher than the conventional temperature, and setting the pressure difference between the inside of the chamber and the inside of the spray nozzle (injection pressure) to 20-80 kPa. Preferably, the injection pressure is 30-80 kPa.

When the temperature of the roller 23 is too low, water molecules adsorbed on the surface of the roller 23 increase the surface roughness and decrease the surface roughness ratio. The reason why the surface roughness ratio becomes small is that the effect of water molecules is greater in the central part 43 than in the edge parts 41. When the temperature of the roller 23 is too high, the ribbon 24 is hard to be formed, and the surface roughness becomes large even if the ribbon 24 can be formed.

When the injection pressure is too small, the ribbon 24 is hard to be formed, and even if the ribbon 24 can be formed, the surface roughness becomes large, and the surface roughness ratio becomes small. When the injection pressure is too large, the edge parts 41 of the ribbon 24 bulge, which increases the surface roughness and the surface roughness ratio.

In the present embodiment, the roller may rotate toward the opposite side to the position of the peeling gas spray device as shown in FIG. 1 or may rotate toward the position of the peeling gas spray device as shown in FIG. 2. As shown in FIG. 1, however, the roller preferably rotates toward the opposite side to the position of the peeling gas spray device. This is because the contact time between the roller 23 and the ribbon 24 becomes long, which makes it easy to rapidly cool the ribbon 24 even if the roller 23 has a high temperature of about 50-90° C. Compared to when the roller 23 rotates as shown in FIG. 2, when the roller 23 rotates as shown in FIG. 1, the contact time between the roller 23 and the ribbon 24 is more easily controlled by changing the peeling gas spray pressure from the peeling gas injection device 26.

In case of a higher temperature of the roller 23 and a longer contact time between the roller 23 and the ribbon 24 compared to prior arts, the cooled ribbon 24 has a high uniformity, and a crystal phase composed of crystals having a grain size of larger than 30 nm is hard to occur. As a result, in spite of a composition where a crystal phase composed of crystals having a grain size of larger than 30 nm is generated in a conventional method, it is possible to obtain a soft magnetic alloy ribbon containing no crystal phases composed of crystals having a grain size of larger than 30 nm. Then, it becomes easy to obtain a soft magnetic alloy ribbon having a structure composed of only amorphousness or a nanohetero structure where initial fine crystals exist in amorphousness.

In the single-roller melt-spinning method, the thickness of the ribbon 24 to be obtained can be controlled by mainly controlling the rotating speed of the roller 23, but can also be controlled by, for example, controlling the distance between the nozzle 21 and the roller 23, the temperature of the molten metal, or the like. Even if the injection pressure is low, the ribbon 24 may be formed by controlling the distance between the nozzle 21 and the roller 23, the temperature of the molten metal, or the like.

The chamber 25 has any inner vapor pressure. For example, the chamber 25 may have an inner vapor pressure of 11 hPa or less using an Ar gas whose dew point is adjusted. Incidentally, the chamber 25 has no lower limit for inner vapor pressure. The chamber 25 may have a vapor pressure of 1 hPa or less by being filled with an Ar gas whose dew point is adjusted or by being turned into a state close to vacuum.

A soft magnetic alloy ribbon 24 before heat treatment mentioned below contains no crystals having a particle size of larger than 30 nm and may have a structure composed of only amorphousness or a nanohetero structure where initial fine crystals exist in amorphousness Incidentally, whether or not the ribbon 24 contains crystals having a particle size of larger than 30 nm is confirmed by any method, such as a normal X-ray diffraction measurement.

The existence and average particle size of the above-mentioned initial fine crystals are observed by any method, and can be observed by, for example, obtaining a selected area electron diffraction image, a nano beam diffraction image, a bright field image, or a high resolution image of a sample thinned by ion milling using a transmission electron microscope. In case of using a selected area electron diffraction image or a nano beam diffraction image, a ring-shaped diffraction is formed when the diffraction pattern is amorphous, and diffraction spots due to crystal structure are formed when the diffraction pattern is not amorphous. In case of using a bright field image or a high resolution image, the existence and the average particle size of initial fine crystals can be observed visually at a magnification of $1.00\times10^5$ to $3.00\times10^5$.

Hereinafter, explained is a method of manufacturing a soft magnetic alloy ribbon having a Fe based nanocrystal structure by carrying out a heat treatment against a soft magnetic alloy ribbon 24. In the present embodiment, the Fe based nanocrystal structure is composed of a crystal phase having an amorphous ratio X of less than 85%. As mentioned above, the amorphous ratio X can be measured by performing X-ray crystal structure analysis with XRD.

The soft magnetic alloy ribbon according to the present embodiment is manufactured with any heat-treatment conditions. Favorable heat-treatment conditions differ depending on a composition of the soft magnetic alloy ribbon. Normally, a heat-treatment temperature is preferably about 450 to 650° C., and a heat-treatment time is preferably about 0.5 to 10 hours, but favorable heat-treatment temperature and heat-treatment time may be in a range deviated from the above ranges depending on the composition. The heat treatment is carried out in any atmosphere, such as an active atmosphere of air and an inert atmosphere of Ar gas.

The average grain size of Fe based nanocrystals contained in the soft magnetic alloy ribbon obtained by heat treatment is calculated in any manner, such as observation using a transmission electron microscope. The crystal structure of bcc (body-centered cubic structure) is also confirmed in any manner, such as X-ray diffraction measurement.

Then, the soft magnetic alloy ribbon obtained by the heat treatment has a surface roughness ratio falling within a predetermined range. A core obtained by winding a soft magnetic alloy ribbon whose surface roughness ratio is within a predetermined range, a core obtained by laminating a soft magnetic alloy ribbon whose surface roughness ratio is within a predetermined range, or the like easily has a high space factor and a high saturation magnetic flux density. Therefore, a good core (particularly, a toroidal core) is obtained.

Incidentally, when the soft magnetic alloy ribbon having a structure composed of amorphous phase undergoes the heat treatment to be the soft magnetic alloy ribbon having a Fe based nanocrystal structure, the surface roughness in the central part and the surface roughness in the edge parts of the peeled surface decrease, and the surface roughness ratio also decreases. Then, the space factor of the core using this soft magnetic alloy ribbon also increases. On the other hand, in case of a soft magnetic alloy ribbon having a structure composed of amorphous phase even after the heat treatment, the surface roughnesses of the peeled surface hardly change. When crystals having a grain size of larger than 30 nm are generated, the surface roughness in the central part and the surface roughness in the edge parts of the peeled surface decrease, but the margins of decrease are smaller compared to those of the soft magnetic alloy ribbon having a Fe based nanocrystal structure. Furthermore, compared to the soft magnetic alloy ribbon having a Fe based nanocrystal structure, the effect of increasing the space factor of the core using the soft magnetic alloy ribbon is also smaller.

(Magnetic Device)

A magnetic device (particularly, cores and inductors) according to the present embodiment is obtained from the soft magnetic alloy ribbon according to the present embodiment. Hereinafter, a method of obtaining a core and an inductor according to the present embodiment is explained, but a core and an inductor according to the present embodiment may be obtained in any other methods. In addition to inductors, the core is used for transformers, motors, or the like.

As a method of obtaining a core from the soft magnetic alloy ribbon, for example, the soft magnetic alloy ribbon is wound or laminated. When the soft magnetic alloy ribbons are laminated via an insulator, it is possible to obtain a core having further improved characteristics.

An inductance component is obtained by winding a wire around the core. The wire is wound in any manner, and the inductance component is manufactured in any manner. For example, a wire is wound around a core manufactured by the above-mentioned method in at least one or more turns.

Hereinbefore, an embodiment of the present invention is explained, but the present invention is not limited to the above embodiment.

EXAMPLES

Hereinafter, the present invention is specifically explained based on Examples.

Experimental Example 1

Raw material metals were weighed so that the alloy composition of $Fe_{0.84}Nb_{0.07}B_{0.09}$ would be obtained, and the weighed raw material metals were melted by high-frequency heating. Then, base alloys were manufactured.

The manufactured base alloys were thereafter melted by heating and turned into a molten metal at 1250° C. This metal was sprayed against a roller rotating at 25 m/sec. (single-roller melt-spinning method), and ribbons were thereby obtained. Incidentally, the roller was made of Cu.

The roller was rotating in the direction shown in FIG. 1, and the roller temperature was set to those shown in Table 1. The differential pressure between the inside of the chamber and the inside of the spray nozzle (injection pressure) was set to those shown in Table 1. The ribbons to be obtained had a thickness of 20 to 30 μm and a length of several tens of meters, provided that the slit width of the slit nozzle was 180 mm, that the distance from the slit opening to the roller was 0.2 mm, and that the roller diameter φ was 300 mm.

Furthermore, whether or not the ribbon before heat treatment was composed of amorphous phase or crystal phase was confirmed. The amorphous ratio X of each ribbon was measured using an XRD. The ribbon having an amorphous ratio X of 85% or more was determined to be composed of amorphous phase, and the ribbon having an amorphous ratio X of less than 85% was determined to be composed of crystal phase. The results are shown in Table 1.

After that, each ribbon of Examples and Comparative Examples underwent a heat treatment at 600° C. for 60 minutes.

Each ribbon after the heat treatment was measured for a surface roughness (arithmetic mean roughness) of a peeled surface. In addition, a surface roughness ratio of a peeled surface was calculated. The surface roughness of the peeled surface was measured in contact manner at three points in each of the edge part and the central part using a contact type surface roughness measuring device conforming to JIS-B0601. The surface roughnesses were averaged. In addition, a surface roughness ratio was calculated.

Moreover, each ribbon after the heat treatment was measured for a surface roughness (maximum height roughness) of a free surface. The surface roughness of the free surface was measured in contact manner at three points in the central part using a contact type surface roughness measuring device conforming to JIS-B0601. In all Examples shown in the present specification, the surface roughness of the free surface was 4.3 μm or less.

Each ribbon after the heat treatment was measured for coercivity and saturation magnetic flux density. The coercivity was measured using an Hc meter. The saturation magnetic flux density was measured at 1000 kA/m (magnetic field) using a vibrating sample magnetometer (VSM). A coercivity of 12.0 A/m or less was determined to be favorable, a coercivity of 5.0 A/m or less was determined to be more favorable, a coercivity of 2.5 A/m or less was determined to be still more favorable, a coercivity of 2.0 A/m or less was determined to be particularly still more favorable, and a coercivity of 1.5 A/m or less was determined to be the most favorable. A saturation magnetic flux density of 1.50 T or more was determined to be favorable.

Unless otherwise noted, an X-ray diffraction measurement and an observation using a transmission electron microscope confirmed that ribbons of all Examples shown below contained Fe based nanocrystals having an average grain size of 5 to 30 nm and a crystal structure of bcc. An ICP analysis also confirmed that the alloy composition did not change before and after the heat treatment.

Furthermore, a core was made using the ribbon of each of Examples and Comparative Examples. First, a ribbon piece (length in the casting direction: 310 mm) was cut out from the ribbon. Next, the cut ribbon piece was punched into 120 flakes with a toroidal shape (outer diameter: 18 mm, inner diameter: 10 mm). Then, the punched ribbon pieces were laminated to obtain a multilayer toroidal core (height: about 3 mm). Incidentally, no heat treatment was carried out in a magnetic field in making the core.

A space factor of the core was obtained from a proportion of a dimensional density of the core and an Archimedes density of the ribbon alone measured in advance. The saturation magnetic flux density of the core was measured with a BH analyzer. A space factor of the core of 85.00% or more was determined to be favorable, and a space factor of the core of 87.50% or more was determined to be more favorable. A saturation magnetic flux density of 1.35 T or more was determined to be favorable.

TABLE 1

| Sample No. | Example/ Comparative Example | Roller Temperature (° C.) | Injection Pressure (kPa) | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|---|---|
| 1 | Comp. Ex. | 10 | 40 | 0.72 | 0.50 | 0.70 | 5.2 | 1.42 | 73.55 | 1.05 |
| 2 | Comp. Ex. | 20 | 40 | 0.58 | 0.45 | 0.78 | 5.1 | 1.49 | 80.86 | 1.20 |
| 6 | Ex. | 50 | 40 | 0.36 | 0.35 | 0.98 | 4.9 | 1.56 | 88.41 | 1.38 |
| 7 | Ex. | 60 | 40 | 0.37 | 0.38 | 1.02 | 4.9 | 1.55 | 88.24 | 1.37 |
| 8 | Ex. | 70 | 40 | 0.34 | 0.34 | 1.00 | 4.9 | 1.55 | 88.47 | 1.38 |
| 9 | Ex. | 80 | 40 | 0.32 | 0.32 | 1.01 | 4.8 | 1.55 | 88.36 | 1.37 |
| 10 | Ex. | 90 | 40 | 0.40 | 0.40 | 0.99 | 4.7 | 1.55 | 88.32 | 1.37 |
| 13 | Ex. | 70 | 20 | 0.47 | 0.41 | 0.87 | 4.9 | 1.55 | 87.30 | 1.35 |
| 14 | Ex. | 70 | 30 | 0.40 | 0.37 | 0.92 | 4.9 | 1.55 | 88.83 | 1.37 |
| 15 | Ex. | 70 | 40 | 0.38 | 0.37 | 0.98 | 4.9 | 1.56 | 89.75 | 1.40 |
| 16 | Ex. | 70 | 50 | 0.34 | 0.36 | 1.05 | 4.7 | 1.55 | 89.87 | 1.39 |
| 17 | Ex. | 70 | 60 | 0.30 | 0.33 | 1.10 | 4.7 | 1.56 | 89.54 | 1.39 |
| 18 | Ex. | 70 | 70 | 0.33 | 0.38 | 1.15 | 4.8 | 1.55 | 89.03 | 1.38 |
| 19 | Ex. | 70 | 80 | 0.36 | 0.43 | 1.20 | 4.6 | 1.55 | 88.49 | 1.37 |

According to Table 1, in Examples having a roller temperature of 50° C. or more and 90° C. or less and an injection pressure of 20 kPa or more and 80 kPa or less, the surface roughness ratio of the ribbon fell within 0.85-1.25, and the magnetic characteristics of the ribbon were favorable. In addition, the core made with this ribbon had a favorable space factor and a favorable saturation magnetic flux density.

On the other hand, in Sample No. 1 and Sample No. 2 (the roller temperature was too low), the surface roughness ratio of the ribbon fell out of 0.85-1.25, and the saturation magnetic flux density of the ribbon decreased. In addition, the core made with this ribbon had a low space factor and a low saturation magnetic flux density.

Experimental Example 2

Experimental Example 2 was carried out with the same conditions as Experimental Example 1 except that base alloys were manufactured by weighing raw material metals so that the alloy compositions of Examples and Comparative Examples shown in the following tables would be obtained and by melting the raw material metals with high-frequency heating.

TABLE 2

| | Example/ | Fe(1 − (a + b + c + d + e + f))MaBbPcSidCeSf (α = β = 0) | | | | | | | XRD Before | |
|---|---|---|---|---|---|---|---|---|---|---|
| Sample No. | Comparative Example | Fe | M(Nb) a | B b | P c | Si d | C e | S f | Heat Treatment | Heat Treatment |
| 22 | Ex. | 0.860 | 0.020 | 0.090 | 0.030 | 0.000 | 0.000 | 0.000 | amorphous phase | yes |
| 23 | Ex. | 0.840 | 0.040 | 0.090 | 0.030 | 0.000 | 0.000 | 0.000 | amorphous phase | yes |
| 24 | Ex. | 0.820 | 0.060 | 0.090 | 0.030 | 0.000 | 0.000 | 0.000 | amorphous phase | yes |
| 39 | Ex. | 0.810 | 0.070 | 0.090 | 0.030 | 0.000 | 0.000 | 0.000 | amorphous phase | yes |
| 25 | Ex. | 0.800 | 0.080 | 0.090 | 0.030 | 0.000 | 0.000 | 0.000 | amorphous phase | yes |
| 26 | Ex. | 0.780 | 0.100 | 0.090 | 0.030 | 0.000 | 0.000 | 0.000 | amorphous phase | yes |
| 27 | Ex. | 0.760 | 0.120 | 0.090 | 0.030 | 0.000 | 0.000 | 0.000 | amorphous phase | yes |
| 28 | Comp. Ex. | 0.730 | 0.150 | 0.090 | 0.030 | 0.000 | 0.000 | 0.000 | amorphous phase | yes |

TABLE 3

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 22 | Ex. | 0.58 | 0.50 | 0.86 | 2.8 | 1.65 | 85.52 | 1.41 |
| 23 | Ex. | 0.42 | 0.39 | 0.92 | 2.4 | 1.64 | 87.43 | 1.43 |
| 24 | Ex. | 0.42 | 0.39 | 0.92 | 1.9 | 1.63 | 87.52 | 1.43 |
| 39 | Ex. | 0.41 | 0.38 | 0.93 | 1.8 | 1.58 | 87.65 | 1.38 |
| 25 | Ex. | 0.36 | 0.38 | 1.05 | 1.8 | 1.58 | 88.55 | 1.40 |
| 26 | Ex. | 0.34 | 0.34 | 1.01 | 2.3 | 1.55 | 88.54 | 1.37 |
| 27 | Ex. | 0.31 | 0.30 | 0.98 | 2.7 | 1.53 | 88.36 | 1.35 |
| 28 | Comp. Ex. | 0.34 | 0.30 | 0.88 | 2.9 | 1.43 | 86.28 | 1.23 |

TABLE 4

| | Example/ | Fe(1 − (a + b + c + d + e + f))MaBbPcSidCeSf (α = β = 0) | | | | | | | XRD Before | |
|---|---|---|---|---|---|---|---|---|---|---|
| Sample No. | Comparative Example | Fe | M(Nb) a | B b | P c | Si d | C e | S f | Heat Treatment | Heat Treatment |
| 29 | Comp. Ex. | 0.885 | 0.070 | 0.015 | 0.030 | 0.000 | 0.000 | 0.000 | crystal phase | yes |
| 30 | Ex. | 0.875 | 0.070 | 0.025 | 0.030 | 0.000 | 0.000 | 0.000 | amorphous phase | yes |
| 31 | Ex. | 0.840 | 0.070 | 0.060 | 0.030 | 0.000 | 0.000 | 0.000 | amorphous phase | yes |
| 32 | Ex. | 0.820 | 0.070 | 0.080 | 0.030 | 0.000 | 0.000 | 0.000 | amorphous phase | yes |
| 33 | Ex. | 0.780 | 0.070 | 0.120 | 0.030 | 0.000 | 0.000 | 0.000 | amorphous phase | yes |

TABLE 4-continued

| Sample No. | Example/ Comparative Example | Fe(1 − (a + b + c + d + e + f))MaBbPcSidCeSf (α = β = 0) Fe | M(Nb) a | B b | P c | Si d | C e | S f | XRD Before Heat Treatment | Heat Treatment |
|---|---|---|---|---|---|---|---|---|---|---|
| 34 | Ex. | 0.750 | 0.070 | 0.150 | 0.030 | 0.000 | 0.000 | 0.000 | amorphous phase | yes |
| 35 | Ex. | 0.700 | 0.070 | 0.200 | 0.030 | 0.000 | 0.000 | 0.000 | amorphous phase | yes |
| 36 | Comp. Ex. | 0.690 | 0.070 | 0.210 | 0.030 | 0.000 | 0.000 | 0.000 | amorphous phase | yes |

TABLE 5

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 29 | Comp. Ex. | 0.74 | 0.60 | 0.82 | 217 | 1.63 | 83.57 | 1.36 |
| 30 | Ex. | 0.59 | 0.52 | 0.87 | 2.6 | 1.61 | 85.92 | 1.38 |
| 31 | Ex. | 0.42 | 0.37 | 0.89 | 2.1 | 1.59 | 86.62 | 1.38 |
| 32 | Ex. | 0.39 | 0.35 | 0.91 | 1.8 | 1.58 | 87.19 | 1.38 |
| 33 | Ex. | 0.34 | 0.33 | 0.97 | 2.0 | 1.55 | 88.27 | 1.37 |
| 34 | Ex. | 0.33 | 0.33 | 0.99 | 2.5 | 1.53 | 88.44 | 1.36 |
| 35 | Ex. | 0.32 | 0.32 | 1.01 | 2.7 | 1.53 | 88.54 | 1.35 |
| 36 | Comp. Ex. | 0.33 | 0.28 | 0.85 | 2.9 | 1.45 | 85.09 | 1.23 |

TABLE 6

| Sample No. | Example/ Comparative Example | Fe(1 − (a + b + c + d + e + f))MaBbPcSidCeSf (α = β = 0) Fe | M(Nb) a | B b | P c | Si d | C e | S f | XRD Before Heat Treatment | Heat Treatment |
|---|---|---|---|---|---|---|---|---|---|---|
| 16 | Ex. | 0.840 | 0.070 | 0.090 | 0.000 | 0.000 | 0.000 | 0.000 | amorphous phase | yes |
| 38 | Ex. | 0.830 | 0.070 | 0.090 | 0.010 | 0.000 | 0.000 | 0.000 | amorphous phase | yes |
| 39 | Ex. | 0.810 | 0.070 | 0.090 | 0.030 | 0.000 | 0.000 | 0.000 | amorphous phase | yes |
| 40 | Ex. | 0.790 | 0.070 | 0.090 | 0.050 | 0.000 | 0.000 | 0.000 | amorphous phase | yes |
| 41 | Ex. | 0.760 | 0.070 | 0.090 | 0.080 | 0.000 | 0.000 | 0.000 | amorphous phase | yes |
| 42 | Ex. | 0.740 | 0.070 | 0.090 | 0.100 | 0.000 | 0.000 | 0.000 | amorphous phase | yes |
| 43 | Ex. | 0.690 | 0.070 | 0.090 | 0.150 | 0.000 | 0.000 | 0.000 | amorphous phase | yes |
| 44 | Comp. Ex. | 0.680 | 0.070 | 0.090 | 0.160 | 0.000 | 0.000 | 0.000 | amorphous phase | yes |

TABLE 7

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 16 | Ex. | 0.34 | 0.36 | 1.05 | 4.7 | 1.55 | 89.87 | 1.39 |
| 38 | Ex. | 0.35 | 0.35 | 1.01 | 4.6 | 1.61 | 88.55 | 1.43 |
| 39 | Ex. | 0.34 | 0.34 | 0.99 | 1.8 | 1.58 | 88.46 | 1.40 |
| 40 | Ex. | 0.34 | 0.34 | 1.01 | 1.8 | 1.57 | 88.54 | 1.39 |
| 41 | Ex. | 0.34 | 0.36 | 1.03 | 2.2 | 1.55 | 88.57 | 1.37 |
| 42 | Ex. | 0.33 | 0.33 | 0.99 | 2.5 | 1.54 | 88.44 | 1.36 |

TABLE 7-continued

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 43 | Ex. | 0.33 | 0.33 | 1.01 | 2.7 | 1.53 | 88.54 | 1.36 |
| 44 | Comp. Ex. | 0.33 | 0.34 | 1.05 | 2.8 | 1.34 | 88.55 | 1.19 |

TABLE 8

| Sample No. | Example/ Comparative Example | Fe(1 − (a + b + c + d + e + f))MaBbPcSidCeSf (α = β = 0) Fe | M(Nb) a | B b | P c | Si d | C e | S f | Heat Treatment | XRD Before Heat Treatment |
|---|---|---|---|---|---|---|---|---|---|---|
| 39 | Ex. | 0.810 | 0.070 | 0.090 | 0.030 | 0.000 | 0.000 | 0.000 | amorphous phase | yes |
| 45 | Ex. | 0.809 | 0.070 | 0.090 | 0.030 | 0.000 | 0.001 | 0.000 | amorphous phase | yes |
| 46 | Ex. | 0.805 | 0.070 | 0.090 | 0.030 | 0.000 | 0.005 | 0.000 | amorphous phase | yes |
| 47 | Ex. | 0.800 | 0.070 | 0.090 | 0.030 | 0.000 | 0.010 | 0.000 | amorphous phase | yes |
| 48 | Ex. | 0.780 | 0.070 | 0.090 | 0.030 | 0.000 | 0.030 | 0.000 | amorphous phase | yes |
| 49 | Comp. Ex. | 0.770 | 0.070 | 0.090 | 0.030 | 0.000 | 0.040 | 0.000 | crystal phase | yes |

TABLE 9

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 39 | Ex. | 0.41 | 0.38 | 0.93 | 1.8 | 1.58 | 87.65 | 1.38 |
| 45 | Ex. | 0.41 | 0.38 | 0.94 | 1.4 | 1.59 | 87.75 | 1.40 |
| 46 | Ex. | 0.41 | 0.38 | 0.94 | 1.2 | 1.58 | 87.84 | 1.39 |
| 47 | Ex. | 0.40 | 0.38 | 0.95 | 1.5 | 1.56 | 88.01 | 1.37 |
| 48 | Ex. | 0.37 | 0.36 | 0.97 | 1.7 | 1.53 | 88.27 | 1.35 |
| 49 | Comp. Ex. | 0.35 | 0.34 | 0.99 | 376 | 1.51 | 88.44 | 1.34 |

TABLE 10

| Sample No. | Example/ Comparative Example | Fe(1 − (a + b + c + d + e + f))MaBbPcSidCeSf (α = β = 0) Fe | M(Nb) a | B b | P c | Si d | C e | S f | Heat Treatment | XRD Before Heat Treatment |
|---|---|---|---|---|---|---|---|---|---|---|
| 39 | Ex. | 0.810 | 0.070 | 0.090 | 0.030 | 0.000 | 0.000 | 0.000 | amorphous phase | yes |
| 50 | Ex. | 0.809 | 0.070 | 0.090 | 0.030 | 0.000 | 0.000 | 0.001 | amorphous phase | yes |
| 51 | Ex. | 0.805 | 0.070 | 0.090 | 0.030 | 0.000 | 0.000 | 0.005 | amorphous phase | yes |
| 52 | Ex. | 0.800 | 0.070 | 0.090 | 0.030 | 0.000 | 0.000 | 0.010 | amorphous phase | yes |
| 53 | Ex. | 0.780 | 0.070 | 0.090 | 0.030 | 0.000 | 0.000 | 0.030 | amorphous phase | yes |
| 54 | Comp. Ex. | 0.770 | 0.070 | 0.090 | 0.030 | 0.000 | 0.000 | 0.040 | crystal phase | yes |

TABLE 11

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 39 | Ex. | 0.41 | 0.38 | 0.93 | 1.8 | 1.58 | 87.65 | 1.38 |
| 50 | Ex. | 0.36 | 0.33 | 0.92 | 2.1 | 1.57 | 87.43 | 1.37 |
| 51 | Ex. | 0.32 | 0.30 | 0.93 | 2.3 | 1.56 | 87.65 | 1.37 |
| 52 | Ex. | 0.33 | 0.32 | 0.98 | 2.2 | 1.53 | 88.36 | 1.35 |
| 53 | Ex. | 0.32 | 0.32 | 1.01 | 2.4 | 1.53 | 88.54 | 1.35 |
| 54 | Comp. Ex. | 0.57 | 0.51 | 0.89 | 345 | 1.55 | 86.62 | 1.34 |

TABLE 12

| | Example/ | Fe(1 − (a + b + c + d + e + f))MaBbPcSidCeSf (α = β = 0) | | | | | | | XRD Before | |
|---|---|---|---|---|---|---|---|---|---|---|
| Sample No. | Comparative Example | Fe | M(Nb) a | B b | P c | Si d | C e | S f | Heat Treatment | Heat Treatment |
| 39 | Ex. | 0.810 | 0.070 | 0.090 | 0.030 | 0.000 | 0.000 | 0.000 | amorphous phase | yes |
| 55 | Ex. | 0.805 | 0.070 | 0.090 | 0.030 | 0.005 | 0.000 | 0.000 | amorphous phase | yes |
| 56 | Ex. | 0.800 | 0.070 | 0.090 | 0.030 | 0.010 | 0.000 | 0.000 | amorphous phase | yes |
| 57 | Ex. | 0.790 | 0.070 | 0.090 | 0.030 | 0.020 | 0.000 | 0.000 | amorphous phase | yes |
| 58 | Ex. | 0.780 | 0.070 | 0.090 | 0.030 | 0.030 | 0.000 | 0.000 | amorphous phase | yes |
| 59 | Ex. | 0.750 | 0.070 | 0.090 | 0.030 | 0.060 | 0.000 | 0.000 | amorphous phase | yes |

TABLE 13

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 39 | Ex. | 0.41 | 0.38 | 0.93 | 1.8 | 1.58 | 87.65 | 1.38 |
| 55 | Ex. | 0.40 | 0.39 | 0.97 | 1.7 | 1.57 | 88.27 | 1.39 |
| 56 | Ex. | 0.37 | 0.37 | 0.98 | 1.6 | 1.55 | 88.36 | 1.37 |
| 57 | Ex. | 0.36 | 0.36 | 1.00 | 1.6 | 1.55 | 88.50 | 1.37 |
| 58 | Ex. | 0.35 | 0.35 | 0.99 | 2.1 | 1.54 | 88.44 | 1.36 |
| 59 | Ex. | 0.32 | 0.33 | 1.02 | 2.5 | 1.53 | 88.56 | 1.35 |

TABLE 14

| | Example / | Fe(1 − (a + b + c + d + e + f))MaBbPcSidCeSf (α = β = 0) | | | | | | | XRD Before | |
|---|---|---|---|---|---|---|---|---|---|---|
| Sample No. | Comparative Example | Fe | M(Nb) a | B b | P c | Si d | C e | S f | Heat Treatment | Heat Treatment |
| 20 | Comp. Ex. | 0.750 | 0.000 | 0.150 | 0.000 | 0.100 | 0.000 | 0.000 | amorphous phase | no |
| 60 | Ex. | 0.850 | 0.000 | 0.090 | 0.050 | 0.010 | 0.000 | 0.000 | amorphous phase | yes |
| 61 | Ex. | 0.830 | 0.000 | 0.090 | 0.050 | 0.030 | 0.000 | 0.000 | amorphous phase | yes |
| 62 | Ex. | 0.810 | 0.000 | 0.090 | 0.050 | 0.050 | 0.000 | 0.000 | amorphous phase | yes |
| 63 | Ex. | 0.790 | 0.000 | 0.090 | 0.050 | 0.070 | 0.000 | 0.000 | amorphous phase | yes |
| 64 | Ex. | 0.770 | 0.000 | 0.090 | 0.050 | 0.090 | 0.000 | 0.000 | amorphous phase | yes |

TABLE 15

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 20 | Comp. Ex. | 0.38 | 0.35 | 0.92 | 16.2 | 1.56 | 87.43 | 1.36 |
| 60 | Ex. | 0.43 | 0.40 | 0.92 | 10.8 | 1.74 | 87.46 | 1.52 |
| 61 | Ex. | 0.33 | 0.32 | 0.96 | 9.5 | 1.73 | 88.15 | 1.52 |
| 62 | Ex. | 0.37 | 0.38 | 1.02 | 9.3 | 1.70 | 88.56 | 1.51 |
| 63 | Ex. | 0.34 | 0.33 | 0.98 | 9.2 | 1.66 | 88.36 | 1.47 |
| 64 | Ex. | 0.33 | 0.34 | 1.01 | 9.4 | 1.64 | 88.54 | 1.45 |

TABLE 16

| | Example / | Fe(1 − (a + b + c + d + e + f))MaBbPcSidCeSf (α = β = 0) | | | | | | | XRD Before | |
|---|---|---|---|---|---|---|---|---|---|---|
| Sample No. | Comparative Example | Fe | M(Zr) a | B b | P c | Si d | C e | S f | Heat Treatment | Heat Treatment |
| 38b | Ex. | 0.910 | 0.060 | 0.020 | 0.010 | 0.000 | 0.000 | 0.000 | amorphous phase | yes |
| 39b | Ex. | 0.890 | 0.060 | 0.020 | 0.030 | 0.000 | 0.000 | 0.000 | amorphous phase | yes |
| 40b | Ex. | 0.870 | 0.060 | 0.020 | 0.050 | 0.000 | 0.000 | 0.000 | amorphous phase | yes |
| 41b | Ex. | 0.820 | 0.060 | 0.020 | 0.100 | 0.000 | 0.000 | 0.000 | amorphous phase | yes |
| 42b | Ex. | 0.770 | 0.060 | 0.020 | 0.150 | 0.000 | 0.000 | 0.000 | amorphous phase | yes |

TABLE 17

| Sample No. | Example/ Comparative Example | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|
| 38b | Ex. | 0.41 | 0.39 | 0.95 | 9.1 | 1.75 | 88.01 | 1.54 |
| 39b | Ex. | 0.41 | 0.39 | 0.97 | 8.4 | 1.71 | 88.27 | 1.51 |
| 40b | Ex. | 0.40 | 0.40 | 0.99 | 8.0 | 1.72 | 88.44 | 1.52 |
| 41b | Ex. | 0.39 | 0.40 | 1.03 | 6.3 | 1.64 | 88.57 | 1.45 |
| 42b | Ex. | 0.38 | 0.39 | 1.02 | 4.6 | 1.57 | 88.56 | 1.39 |

TABLE 18

| Sample No. | Example/ Comparative Example | Fe(1 − (a + b + c + d + e + f)) MaBbPcSidCeSf (same as Sample No. 39 other than the type of M) M Type | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|---|
| 39 | Ex. | Nb | 0.41 | 0.38 | 0.93 | 1.8 | 1.58 | 87.65 | 1.38 |
| 65 | Ex. | Hf | 0.41 | 0.38 | 0.93 | 1.8 | 1.56 | 87.55 | 1.37 |
| 66 | Ex. | Zr | 0.41 | 0.38 | 0.92 | 1.7 | 1.56 | 87.52 | 1.37 |
| 67 | Ex. | Ta | 0.38 | 0.35 | 0.93 | 1.7 | 1.56 | 87.65 | 1.37 |
| 68 | Ex. | Mo | 0.36 | 0.38 | 1.05 | 2.0 | 1.56 | 88.55 | 1.38 |
| 69 | Ex. | W | 0.34 | 0.34 | 1.01 | 2.0 | 1.58 | 88.54 | 1.40 |
| 70 | Ex. | V | 0.31 | 0.30 | 0.98 | 1.9 | 1.56 | 88.36 | 1.38 |
| 71 | Ex. | Ti | 0.36 | 0.38 | 1.05 | 2.0 | 1.56 | 88.55 | 1.38 |
| 72 | Ex. | $Nb_{0.5}Hf_{0.5}$ | 0.34 | 0.34 | 1.01 | 1.8 | 1.58 | 88.54 | 1.40 |
| 73 | Ex. | $Zr_{0.5}Ta_{0.5}$ | 0.31 | 0.30 | 0.98 | 1.9 | 1.56 | 88.36 | 1.38 |
| 74 | Ex. | $Nb_{0.4}Hf_{0.3}Zr_{0.3}$ | 0.34 | 0.32 | 0.93 | 2.0 | 1.56 | 87.59 | 1.37 |

TABLE 19

| Sample No. | Example/ Comparative Example | Fe(1 − ( α + β)) X1αX2β (a to f were the same as those of Sample No. 39) X1 Type | α{1 − (a + b + c + d + e + f)} | X2 Type | β{1 − (a + b + c + d + e + f)} | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|---|---|---|---|
| 39 | Ex. | — | 0.000 | — | 0.000 | 0.41 | 0.38 | 0.93 | 1.8 | 1.58 | 87.65 | 1.38 |
| 75 | Ex. | Co | 0.010 | — | 0.000 | 0.37 | 0.35 | 0.94 | 2.1 | 1.59 | 87.81 | 1.40 |
| 76 | Ex. | Co | 0.100 | — | 0.000 | 0.35 | 0.32 | 0.93 | 2.5 | 1.61 | 87.69 | 1.41 |
| 77 | Ex. | Co | 0.400 | — | 0.000 | 0.37 | 0.35 | 0.95 | 2.9 | 1.64 | 87.97 | 1.44 |
| 78 | Ex. | Ni | 0.010 | — | 0.000 | 0.34 | 0.33 | 0.96 | 1.8 | 1.57 | 88.19 | 1.38 |
| 79 | Ex. | Ni | 0.100 | — | 0.000 | 0.32 | 0.32 | 1.01 | 1.7 | 1.55 | 88.52 | 1.37 |
| 80 | Ex. | Ni | 0.400 | — | 0.000 | 0.38 | 0.37 | 0.97 | 1.6 | 1.53 | 88.27 | 1.35 |

TABLE 20

| Sample No. | Example/ Comparative Example | Fe(1 − ( α + β)) X1αX2β (a to f were the same as those of Sample No. 39) X1 Type | α{1 − (a + b + c + d + e + f)} | X2 Type | β{1 − (a + b + c + d + e + f)} | Surface Rougness in Central Part $Ra_c$ (μm) | Surface Rougness in Edge Parts $Ra_e$ (μm) | Surface Rougness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|---|---|---|---|
| 39 | Ex. | — | 0.000 | — | 0.000 | 0.41 | 0.38 | 0.93 | 1.8 | 1.58 | 87.65 | 1.38 |
| 81 | Ex. | — | 0.000 | Al | 0.001 | 0.37 | 0.38 | 1.02 | 1.8 | 1.58 | 88.56 | 1.40 |
| 82 | Ex. | — | 0.000 | Al | 0.005 | 0.31 | 0.30 | 0.98 | 1.8 | 1.57 | 88.33 | 1.39 |
| 83 | Ex. | — | 0.000 | Al | 0.010 | 0.36 | 0.37 | 1.04 | 1.7 | 1.57 | 88.56 | 1.39 |
| 84 | Ex. | — | 0.000 | Al | 0.030 | 0.39 | 0.39 | 1.00 | 1.8 | 1.56 | 88.49 | 1.38 |
| 85 | Ex. | — | 0.000 | Zn | 0.001 | 0.35 | 0.37 | 1.04 | 1.8 | 1.56 | 88.56 | 1.38 |
| 86 | Ex. | — | 0.000 | Zn | 0.005 | 0.30 | 0.29 | 0.95 | 1.9 | 1.58 | 88.19 | 1.39 |
| 87 | Ex. | — | 0.000 | Zn | 0.010 | 0.34 | 0.33 | 0.97 | 1.8 | 1.56 | 88.29 | 1.38 |
| 88 | Ex. | — | 0.000 | Zn | 0.030 | 0.32 | 0.30 | 0.93 | 1.9 | 1.57 | 87.63 | 1.38 |
| 89 | Ex. | — | 0.000 | Sn | 0.001 | 0.33 | 0.31 | 0.93 | 1.8 | 1.58 | 87.55 | 1.38 |
| 90 | Ex. | — | 0.000 | Sn | 0.005 | 0.35 | 0.33 | 0.96 | 1.9 | 1.57 | 88.11 | 1.38 |
| 91 | Ex. | — | 0.000 | Sn | 0.010 | 0.31 | 0.31 | 0.98 | 1.9 | 1.58 | 88.35 | 1.40 |
| 92 | Ex. | — | 0.000 | Sn | 0.030 | 0.35 | 0.33 | 0.94 | 2.0 | 1.56 | 87.80 | 1.37 |
| 93 | Ex. | — | 0.000 | Cu | 0.001 | 0.37 | 0.34 | 0.94 | 1.6 | 1.58 | 87.86 | 1.39 |
| 94 | Ex. | — | 0.000 | Cu | 0.005 | 0.35 | 0.33 | 0.94 | 1.7 | 1.58 | 87.82 | 1.39 |
| 95 | Ex. | — | 0.000 | Cu | 0.010 | 0.34 | 0.32 | 0.95 | 1.5 | 1.58 | 87.96 | 1.39 |
| 96 | Ex. | — | 0.000 | Cu | 0.030 | 0.34 | 0.34 | 1.00 | 1.6 | 1.60 | 88.50 | 1.42 |

45

TABLE 21

| Sample No. | Example/ Comparative Example | Fe(1 − ( α + β)) X1αX2β (a to f were the same as those of Sample No. 39) X1 Type | α{1 − (a + b + c + d + e + f)} | X2 Type | β{1 − (a + b + c + d + e + f)} | Surface Rougness in Central Part $Ra_c$ (μm) | Surface Rougness in Edge Parts $Ra_e$ (μm) | Surface Rougness Ratio $Ra_c/Ra_e$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|---|---|---|---|
| 39 | Ex. | — | 0.000 | — | 0.000 | 0.41 | 0.38 | 0.93 | 1.8 | 1.58 | 87.65 | 1.38 |
| 97 | Ex. | — | 0.000 | Cr | 0.001 | 0.32 | 0.31 | 0.96 | 1.8 | 1.58 | 88.35 | 1.40 |
| 98 | Ex. | — | 0.000 | Cr | 0.005 | 0.30 | 0.28 | 0.93 | 1.7 | 1.57 | 87.67 | 1.38 |
| 99 | Ex. | — | 0.000 | Cr | 0.010 | 0.37 | 0.34 | 0.92 | 1.8 | 1.56 | 87.52 | 1.37 |
| 100 | Ex. | — | 0.000 | Cr | 0.030 | 0.38 | 0.36 | 0.95 | 1.9 | 1.57 | 88.03 | 1.38 |
| 101 | Ex. | — | 0.000 | Bi | 0.001 | 0.34 | 0.32 | 0.95 | 1.8 | 1.57 | 88.06 | 1.38 |
| 102 | Ex. | — | 0.000 | Bi | 0.005 | 0.31 | 0.30 | 0.97 | 1.7 | 1.56 | 88.26 | 1.38 |
| 103 | Ex. | — | 0.000 | Bi | 0.010 | 0.33 | 0.31 | 0.94 | 1.8 | 1.55 | 87.79 | 1.36 |
| 104 | Ex. | — | 0.000 | Bi | 0.030 | 0.34 | 0.34 | 1.00 | 2.0 | 1.54 | 88.48 | 1.36 |
| 105 | Ex. | — | 0.000 | La | 0.001 | 0.33 | 0.31 | 0.94 | 1.8 | 1.58 | 87.84 | 1.39 |
| 106 | Ex. | — | 0.000 | La | 0.005 | 0.36 | 0.37 | 1.04 | 1.9 | 1.57 | 88.57 | 1.39 |

TABLE 21-continued

| Sample No. | Example/ Comparative Example | Fe(1 − ( α + β)) X1αX2β (a to f were the same as those of Sample No. 39) X1 Type | α{1 − (a + b + c + d + e + f)} | X2 Type | β{1 − (a + b + c + d + e + f)} | Surface Roughness in Central Part $Ra_c$ (μm) | Surface Roughness in Edge Parts $Ra_e$ (μm) | Surface Roughness Ratio $Ra_c/Ra_e$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|---|---|---|---|
| 107 | Ex. | — | 0.000 | La | 0.010 | 0.39 | 0.39 | 0.96 | 1.8 | 1.55 | 88.36 | 1.37 |
| 108 | Ex. | — | 0.000 | La | 0.030 | 0.40 | 0.41 | 1.03 | 1.9 | 1.57 | 88.57 | 1.39 |
| 109 | Ex. | — | 0.000 | Y | 0.001 | 0.38 | 0.39 | 1.02 | 1.9 | 1.57 | 88.57 | 1.39 |
| 110 | Ex. | — | 0.000 | V | 0.005 | 0.40 | 0.41 | 1.04 | 1.8 | 1.55 | 88.56 | 1.37 |
| 111 | Ex. | — | 0.000 | Y | 0.010 | 0.31 | 0.29 | 0.94 | 1.8 | 1.54 | 87.85 | 1.35 |
| 112 | Ex. | — | 0.000 | Y | 0.030 | 0.36 | 0.33 | 0.93 | 2.0 | 1.55 | 87.61 | 1.36 |
| 113 | Ex. | — | 0.000 | N | 0.001 | 0.31 | 0.31 | 1.01 | 2.0 | 1.55 | 88.54 | 1.37 |
| 114 | Ex. | — | 0.000 | O | 0.001 | 0.38 | 0.38 | 0.99 | 1.9 | 1.56 | 88.45 | 1.38 |

TABLE 22

| Sample No. | Example/ Comparative Example | Fe(1 − ( α + β)) X1αX2β (a to f were the same as those of Sample No. 39) X1 Type | α{1 − (a + b + c + d + e + f)} | X2 Type | β{1 − (a + b + c + d + e + f)} | Surface Roughness in Central Part $Ra_c$ (μm) | Surface Roughness in Edge Parts $Ra_e$ (μm) | Surface Roughness Ratio $Ra_e/Ra_c$ | Coercivity of Ribbon (A/m) | Saturation Magnetic Flux Density of Ribbon (T) | Space Factor of Core (%) | Saturation Magnetic Flux Density of Core (T) |
|---|---|---|---|---|---|---|---|---|---|---|---|---|
| 39 | Ex. | — | 0.000 | — | 0.000 | 0.41 | 0.38 | 0.93 | 1.8 | 1.58 | 87.65 | 1.38 |
| 115 | Ex. | Co | 0.100 | Al | 0.050 | 0.38 | 0.36 | 0.94 | 2.1 | 1.58 | 87.78 | 1.39 |
| 116 | Ex. | Co | 0.100 | Zn | 0.050 | 0.37 | 0.36 | 0.96 | 2.2 | 1.60 | 88.19 | 1.41 |
| 117 | Ex. | Co | 0.100 | So | 0.050 | 0.37 | 0.35 | 0.93 | 2.2 | 1.59 | 87.73 | 1.39 |
| 118 | Ex. | Co | 0.100 | Cu | 0.050 | 0.30 | 0.28 | 0.93 | 2.0 | 1.59 | 87.59 | 1.39 |
| 119 | Ex. | Co | 0.100 | Cr | 0.050 | 0.35 | 0.36 | 1.03 | 2.1 | 1.59 | 88.57 | 1.41 |
| 120 | Ex. | Co | 0.100 | Bi | 0.050 | 0.39 | 0.39 | 1.00 | 2.2 | 1.57 | 88.49 | 1.39 |
| 121 | Ex. | Co | 0.100 | La | 0.050 | 0.39 | 0.41 | 1.04 | 2.3 | 1.58 | 88.56 | 1.40 |
| 122 | Ex. | Co | 0.100 | Y | 0.050 | 0.35 | 0.36 | 1.03 | 2.3 | 1.59 | 88.57 | 1.41 |
| 123 | Ex. | Ni | 0.100 | Al | 0.050 | 0.34 | 0.32 | 0.95 | 1.7 | 1.54 | 87.93 | 1.35 |
| 124 | Ex. | Ni | 0.100 | Zn | 0.050 | 0.36 | 0.36 | 1.02 | 1.7 | 1.53 | 88.56 | 1.35 |
| 125 | Ex. | Ni | 0.100 | Sn | 0.050 | 0.31 | 0.31 | 0.98 | 1.6 | 1.54 | 88.40 | 1.36 |
| 126 | Ex. | Ni | 0.100 | Cu | 0.050 | 0.35 | 0.32 | 0.93 | 1.6 | 1.55 | 87.73 | 1.36 |
| 127 | Ex. | Ni | 0.100 | Cr | 0.050 | 0.33 | 0.31 | 0.94 | 1.7 | 1.54 | 87.81 | 1.35 |
| 128 | Ex. | Ni | 0.100 | Bi | 0.050 | 0.38 | 0.35 | 0.93 | 1.8 | 1.55 | 87.55 | 1.36 |
| 129 | Ex. | Ni | 0.100 | La | 0.050 | 0.31 | 0.30 | 0.97 | 1.8 | 1.54 | 88.25 | 1.36 |
| 130 | Ex. | Ni | 0.100 | Y | 0.050 | 0.34 | 0.34 | 0.98 | 1.8 | 1.53 | 88.36 | 1.35 |

Table 2 and Table 3 show examples and a comparative example whose M content (a) was changed. Incidentally, the type of M was Nb. In the examples (each component content was in a predetermined range), the ribbon had a surface roughness ratio of 0.85-1.25 and favorable magnetic characteristics, and the core made with the ribbon had a favorable space factor and a favorable saturation magnetic flux density. On the other hand, in the comparative example (M content (a) was too large), the ribbon had a low saturation magnetic flux density, and the core had a low magnetic flux density.

Table 4 and Table 5 show examples and comparative examples whose B content (a) was changed. In the examples (each component content was in a predetermined range), the ribbon had a surface roughness ratio of 0.85-1.25 and favorable magnetic characteristics, and the core made with the ribbon had a favorable space factor and a favorable saturation magnetic flux density. On the other hand, in the comparative example whose B content (b) was too large, the ribbon before the heat treatment was composed of crystal phase, the coercivity after the heat treatment was remarkably large, the surface roughness ratio was out of 0.85-1.25, and the core had a low space factor. In the comparative example whose B content (b) was too large, the ribbon had a low saturation magnetic flux density, and the core had a low magnetic flux density.

Table 6 and Table 7 show examples and a comparative example whose P content (c) was changed. In the examples (each component content was in a predetermined range), the ribbon had a surface roughness ratio of 0.85-1.25 and favorable magnetic characteristics, and the core made with the ribbon had a favorable space factor and a favorable saturation magnetic flux density. On the other hand, in the comparative example (P content (c) was too large), the ribbon had a low saturation magnetic flux density, and the core had a low magnetic flux density.

Table 8 and Table 9 show examples and a comparative example whose C content (e) was changed. In the examples (each component content was in a predetermined range), the ribbon had a surface roughness ratio of 0.85-1.25 and favorable magnetic characteristics, and the core made with the ribbon had a favorable space factor and a favorable saturation magnetic flux density. On the other hand, in the comparative example (C content (e) was too large), the ribbon before the heat treatment was composed of crystal phase, and the coercivity after the heat treatment was remarkably large.

Table 10 and Table 11 show examples and a comparative example whose S content (f) was changed. In the examples (each component content was in a predetermined range), the ribbon had a surface roughness ratio of 0.85-1.25 and favorable magnetic characteristics, and the core made with the ribbon had a favorable space factor and a favorable saturation magnetic flux density. On the other hand, in the comparative example (S content (f) was too large), the ribbon before the heat treatment was composed of crystal phase, and the coercivity after the heat treatment was remarkably large.

Table 12 and Table 13 show examples whose Si content (d) was changed. In the examples (each component content was in a predetermined range), the ribbon had a surface roughness ratio of 0.85-1.25 and favorable magnetic characteristics, and the core made with the ribbon had a favorable space factor and a favorable saturation magnetic flux density.

Table 14 and Table 15 show examples and a comparative example whose M content (a) was zero and Si content (d) was changed. Incidentally, Sample No. 20 underwent no heat treatment and was made as a Fe amorphous alloy ribbon having a conventionally known composition. In the examples (each component content was in a predetermined range), the ribbon had a surface roughness ratio of 0.85-1.25 and favorable magnetic characteristics, and the core made with the ribbon had a favorable space factor and a favorable saturation magnetic flux density. On the other hand, compared to the ribbons of the examples, Sample No. 20 had a higher coercivity.

Table 16 and Table 17 show examples where the Fe content was larger and the B content was smaller than those of the examples shown in Table 6 and Table 7, M was Zr, and the P content (c) was changed. In the examples (each component content was in a predetermined range), the ribbon had a surface roughness ratio of 0.85-1.25 and favorable magnetic characteristics, and the core made with the ribbon had a favorable space factor and a favorable saturation magnetic flux density.

Table 18 shows examples where the type of M was changed. In the examples (the type of M was changed to a predetermined type), the ribbon had a surface roughness ratio of 0.85-1.25 and favorable magnetic characteristics, and the core made with the ribbon had a favorable space factor and a favorable saturation magnetic flux density.

Table 19 to Table 22 show examples where the type and amount of X1 and/or X2 were changed. In the examples (the type of X1 and/or X2 was changed to a predetermined type and the amount of X1 and/or X2 was changed within a predetermined range), the ribbon had a surface roughness ratio of 0.85-1.25 and favorable magnetic characteristics, and the core made with the ribbon had a favorable space factor and a favorable saturation magnetic flux density.

Experimental Example 3

Sample No. 20 (comparative example) and Sample No. 39 (example) of Experimental Example 2 were observed in terms of change in structure, surface roughness, and coercivity before and after the heat treatment.

Sample No. 20 (no heat treatment was carried out in Experimental Example 2) underwent a heat treatment at the heat treatment temperature for the heat treatment time shown in Table 23 and was observed for structure, surface roughness, and coercivity in case of performing the heat treatment. The structure and the surface roughness are shown in Table 23. In Table 23, the XRD measurement result after the heat treatment in the sample not subjected to the heat treatment was the same as those before the heat treatment.

Sample No. 39 (heat treatment was carried out in Experimental Example 2) was observed for structure, surface roughness, and coercivity in case of not performing the heat treatment. The structure and the surface roughness are shown in Table 23. In Table 23, the XRD measurement result after the heat treatment in the sample not subjected to the heat treatment was the same as those before the heat treatment.

TABLE 23

| Sample No. | Before Heat Treatment/ After Heat Treatment | Temperature of Heat Treatment (C.) | Time of Heat Treatment (min) | XRD Before Heat Treatment | XRD After Heat Treatment | Surface Roughness in Central Part $Ra_c$ (μm) | Surface Roughness in Edge Parts $Ra_e$ (μm) | Surface Roughness Ratio $Ra_e/Ra_c$ |
|---|---|---|---|---|---|---|---|---|
| 20 | before | no | no | amorphous phase | amorphous phase | 0.38 | 0.35 | 0.92 |
| 20a | after | 300 | 60 | amorphous phase | amorphous phase | 0.38 | 0.35 | 0.92 |
| 20b | after | 600 | 60 | amorphous phase | (coarse) crystal phase | 0.37 | 0.34 | 0.91 |
| 39a | before | no | no | amorphous phase | amorphous phase | 0.42 | 0.39 | 0.92 |
| 39 | after | 600 | 60 | amorphous phase | nanocrystal phase | 0.41 | 0.37 | 0.91 |

As shown in Table 23, with regard to Sample 20, which did not contain M and had the Si content (d) out of the range of the present invention, the surface roughness did not substantially change, and the coercivity decreased slightly in Sample No. 20a (no crystals were generated after the heat treatment). In Sample No. 20b (the heat treatment temperature was higher than that of Sample No. 20a), there were (coarse) crystals whose grain size is larger than 30 nm after the heat treatment, the surface roughness of the central part and the surface roughness of the edge parts decreased slightly, and the coercivity increased remarkably.

Thus, in Sample No. 20 (the composition was out of the range of the present invention), even though the heat treatment was carried out, the surface roughness did not change, and the coercivity decreased slightly; or large crystals were generated, the surface roughness decreased slightly, and the coercivity increased remarkably.

As shown in Table 23, Sample No. 39 before the heat treatment (Sample No. 39a) and Sample No. 39 after the heat treatment were compared to each other. In case of generation of Fe based nanocrystals having a composition within a predetermined range, an average grain size of 5-30 nm by the heat treatment, and a crystal structure of bcc, the surface roughness of the central part and the surface roughness of the edge parts decreased greatly after the heat treatment compared to those before the heat treatment. Incidentally, the coercivity decreased greatly due to the heat treatment. It is thereby understood that the generation of the Fe based nanocrystals due to the heat treatment reduced the surface roughnesses and the coercivity. Incidentally, the surface roughness ratio also decreased. That is, the decrease margin of the surface roughness due to the heat treatment was slightly larger in the edge parts than in the central part.

NUMERICAL REFERENCES

21 . . . nozzle
22 . . . molten metal
23 . . . roller
24 . . . (soft magnetic alloy) ribbon
24*a* . . . peeled surface
24*b* . . . free surface
25 . . . chamber
26 . . . peeling gas injection device
41 . . . edge part
43 . . . central part

The invention claimed is:

1. A soft magnetic alloy ribbon comprising a main component of $(Fe_{(1-(\alpha+\beta))}X1_{\alpha}X2_{\beta})_{(1-(a+b+c+d+e+f))}M_aB_bP_cSi_dC_eS_f$ (atomic ratio), in which X1 is one or more of Co and Ni, X2 is one or more of Al, Mn, Ag, Zn, Sn, As, Sb, Cu, Cr, Bi, N, O, and rare earth elements, M is one or more of Nb, Hf, Zr, Ta, Mo, W, Ti, and V, $0 \le a \le 0.140$, $0.020 \le b \le 0.200$, $0 \le c \le 0.150$, $0 \le d \le 0.090$, $0 \le e \le 0.030$, $0 \le f \le 0.030$, $\alpha \ge 0$, $\beta \ge 0$, and $0 \le \alpha+\beta \le 0.50$ are satisfied, and at least one or more of a, c, and d are larger than zero, wherein the soft magnetic alloy ribbon has a Fe based nanocrystal structure, the soft magnetic alloy ribbon has a peeled surface and a free surface both perpendicular to a thickness direction of the ribbon, the soft magnetic alloy ribbon has edge parts and a central part along a width direction of the ribbon, and $0.85 \le Ra_c/Ra_e \le 1.25$ is satisfied in measuring an arithmetic mean roughness along the width direction on the peeled surface, where $Ra_c$ is an average of arithmetic mean roughnesses in the central part, and $Ra_e$ is an average of arithmetic mean roughnesses in the edge parts.

2. The soft magnetic alloy ribbon according to claim 1, wherein the Fe based nanocrystals have an average grain size of 5 to 30 nm.

3. The soft magnetic alloy ribbon according to claim 1, wherein $0.73 \le 1-(a+b+c+d+e+f) \le 0.91$ is satisfied.

4. The soft magnetic alloy ribbon according to claim 1, wherein $0 \le \alpha\{1-(a+b+c+d+e+f)\} \le 0.40$ is satisfied.

5. The soft magnetic alloy ribbon according to claim 1, wherein $\alpha=0$ is satisfied.

6. The soft magnetic alloy ribbon according to claim 1, wherein $0 \le \beta\{1-(a+b+c+d+e+f)\} \le 0.030$ is satisfied.

7. The soft magnetic alloy ribbon according to claim 1, wherein $\beta=0$ is satisfied.

8. The soft magnetic alloy ribbon according to claim 1, wherein $\alpha=\beta=0$ is satisfied.

9. The soft magnetic alloy ribbon according to claim 1, wherein $Ra_c$ is 0.50 μm or less.

10. The soft magnetic alloy according to claim 1, wherein an average of maximum height roughnesses along a casting direction of the ribbon on the free surface is 0.43 μm or less.

11. A magnetic device comprising the soft magnetic alloy ribbon according to claim 1.

12. The soft magnetic alloy ribbon according to claim 1, wherein $0.080 \le b \le 0.200$.

13. The soft magnetic alloy ribbon according to claim 1, wherein $0.070 \le a \le 0.140$.

14. Tge soft magnetic alloy ribbon according to claim 1, wherein $0 < d \le 0.090$.

* * * * *